United States Patent [19]

Bonnema

[11] 4,308,670

[45] Jan. 5, 1982

[54] AXIAL FAN HAIR DRYER

[75] Inventor: James V. Bonnema, Peabody, Mass.

[73] Assignee: The Gillette Company, Boston, Mass.

[21] Appl. No.: 187,611

[22] Filed: Sep. 15, 1980

Related U.S. Application Data

[63] Continuation of Ser. No. 43,909, May 30, 1979, abandoned.

[51] Int. Cl.[3] ..... A45D 20/10

[52] U.S. Cl. ..... 34/97; 132/9; 219/370

[58] Field of Search ..... 34/97, 100; 132/9; 219/361, 369, 370, 371, 372, 374; 415/216; 416/93 R, 241 A, 244 R

[56] References Cited

U.S. PATENT DOCUMENTS

| | | | |
|---|---|---|---|
| 3,261,107 | 7/1966 | Ponczek et al. | 34/99 |
| 3,800,810 | 4/1974 | Mercer | 132/9 |
| 3,840,030 | 10/1974 | Baker | 132/9 |
| 3,857,016 | 12/1974 | Meyer et al. | 34/97 X |
| 4,195,217 | 3/1980 | Moller et al. | 34/97 X |

FOREIGN PATENT DOCUMENTS

| | | | |
|---|---|---|---|
| 413788 | 5/1946 | Italy | 219/370 |
| 7600647 | 7/1977 | Netherlands | 219/370 |
| 1057574 | 2/1967 | United Kingdom | 219/370 |
| 1218060 | 1/1971 | United Kingdom | 214/370 |
| 1414891 | 11/1975 | United Kingdom | 416/93 R |
| 1546318 | 5/1979 | United Kingdom . | |
| 615252 | 7/1978 | U.S.S.R. | 415/216 |

*Primary Examiner*—Henry C. Yuen
*Assistant Examiner*—Harold Joyce
*Attorney, Agent, or Firm*—Raymond J. De Vellis

[57] ABSTRACT

A hand-held portable axial fan hair dryer having an air inlet and an air outlet is provided with a shield and collar assembly proximate the air inlet to substantially prevent hair knotting and tangling. Hair styling attachments, such as a comb or brush, may be removably attached proximate the air outlet.

7 Claims, 3 Drawing Figures

AXIAL FAN HAIR DRYER

This application is a continuation of application Ser. No. 043,909, filed May 30, 1979, now abandoned.

BACKGROUND OF THE INVENTION

This invention relates to portable hair dryers used in close proximity to the user's hair. More specifically, this invention relates to axial fan driven portable hair dryers with means for preventing hair entanglement of the user when the hair dryer is used in close proximity with the hair, such as during a styling or drying maneuver.

In the past, most electrically heated forced-air hair dryers included a transverse flow fan when used with styling attachments such as a comb or a brush. Axial fan hair dryers when used with attachments were typically bulky in nature and inconvenient to use.

If a more compact design of a portable axial fan hair dryer with or without attachments was desirable, a problem resulted in that the working end would be within a few inches of the axial fan. This may result in hair entanglement through the air inlet of the hair dryer.

The prevention of hair entanglement through the air inlet may be somewhat helped by including a mesh screen over the air inlet. However, the mesh may not be too fine since it will cause lint or the like to clog up the air inlet screen and thus restrict air flow causing the unit to overheat.

When a compact hair dryer, with a relatively short air flow portion, is used with or without styling implements, the hair of the user may readily enter through the air inlet portion of the hair dryer either when still attached to the user's head or as separate pieces of hair. The aerodynamics of the hair dryer system and the presenting of the center of rotation of the axial fan very proximate the air inlet is believed to create hair entanglement problems more serious than those associated with a transverse flow hair dryer used with styling attachments.

There are two basic types of hair entanglement problems which will effect the operation of the hair dryer and/or the safety or ease of use of the hair dryer. The first type deals with hair entanglement when the hair remains attached to the user's head. If hair enters through the air inlet portion of the hair dryer, the hair strands may engage the fan shaft or its associated bearing and result in the fan stalling. Such an entanglement may cause the user to be pulled toward the dryer, and if the fan stalls, a situation may momentarily exist where the user is attached to the hair dryer and the heat of the hair dryer is increasing.

Another hair entanglement problem occurs when hair strands of the user enter through the air inlet in front of the fan. Because the center of rotation of the axial fan faces the air inlet, the hair strands tend to find the center of the system and start to twist. If such a twisting occurs among several strands, the hair may become twisted together and form a knot inside the screen thus causing the user to either pull free or cut the entangled hair.

Further problems result when loose hair falls into the air inlet portion through the screen. These loose hairs may eventually wrap around the shaft beneath the fan until they fill up whatever space is available. When the loose hair builds up, the fan may slow down and cause an associated thermostat to open which ultimately may result in consumer dissatisfaction and excessive returns.

These prior art difficulties have been substantially overcome by providing a compact axial fan hair dryer suitable for use as a dryer or styler in close proximity to the hair. The hair dryer includes a stationary guard or shield assembly in the air inlet portion of the hair dryer and a collar affixed to the downstream portion of the fan blades and disposed about the motor.

SUMMARY OF THE INVENTION

It is an object of this invention to provide an axial fan hair dryer which may be used in a safe and convenient manner in close proximity to the hair.

It is another object of this invention to provide a compact axial fan hair dryer which substantially prevents hair knotting and tangling problems.

It is a further object of this invention to provide an axial fan compact hair dryer which may be used with a plurality of styling attachments which includes means for substantially preventing hair entanglement of the user without unreasonably interfering with the air flow dynamics of the system.

Briefly stated, and according to an aspect of this invention, an axial fan hair dryer is provided which substantially prevents hair entanglement problems by means of a stationary shield and a rotating collar without detrimentally affecting the air flow characteristics of the system.

BRIEF DESCRIPTION OF THE DRAWINGS

The invention both as to its organization and principles of operation, together with further objects and advantages thereof, may better be understood by referring to the following detailed description of an embodiment of the invention taken in conjunction with the accompanying drawings in which.

DETAILED DESCRIPTION

Figure 1:
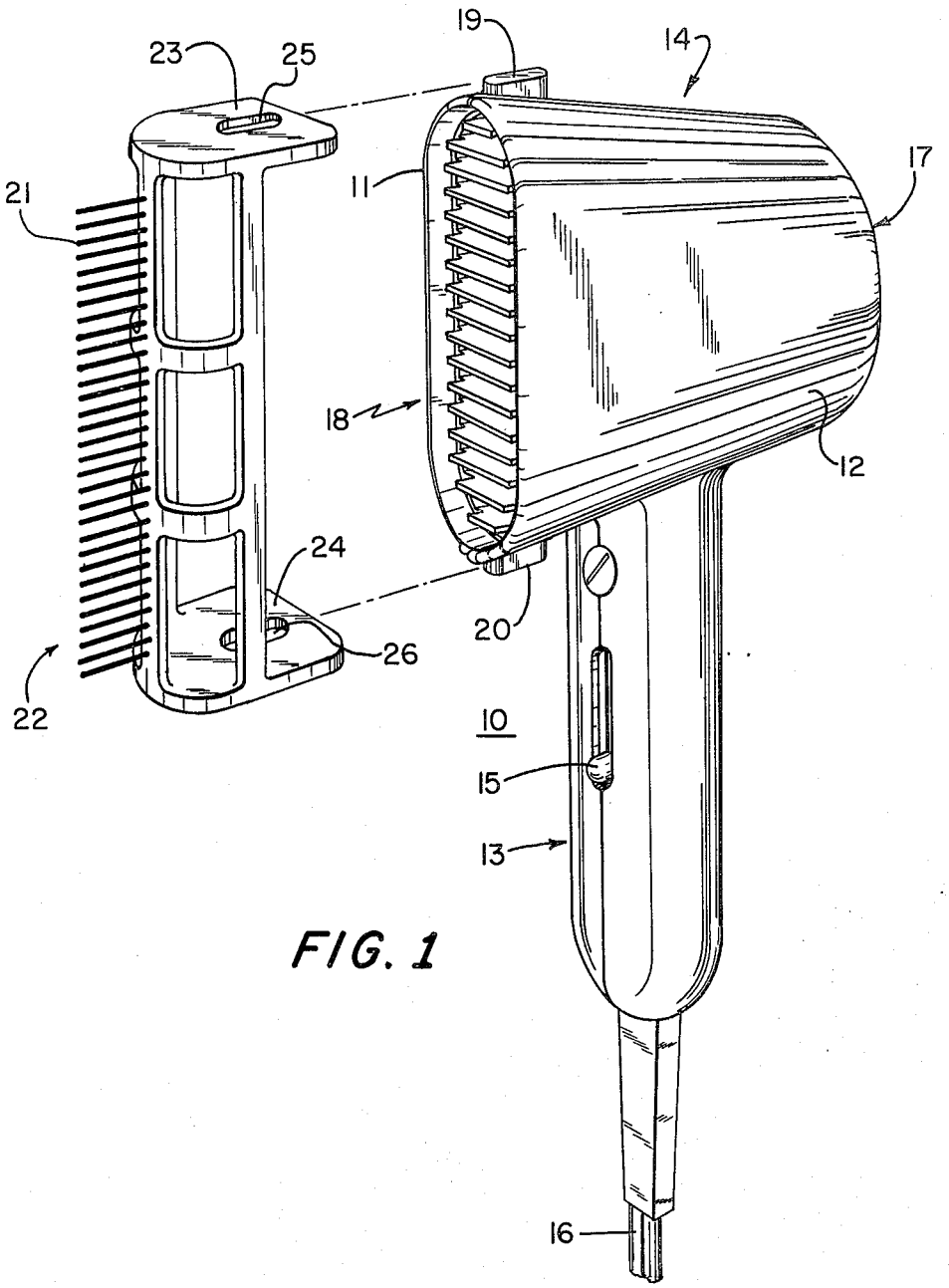
FIG. 1 is a perspective view of a compact axial fan hair dryer and an associated styling attachment, in accordance with this invention.

Referring now to FIG. 1, the hair dryer includes a dryer housing 10 which is preferably made of plastic and comprises separate mating sections 11 and 12. The sections 11 and 12 are connected together by means of snap locks located along their respective periphery and also by means of screws (not shown) or the like. The housing 10 includes handle portion 13 which is generally cylindrical or eliptical in cross section to provide a comfortable grip for the user, and an air flow portion 14.

The handle portion 13 provides an aperture for access to an on/off switch 15. The on/off switch 15 is electrically connected to an AC line cord 16 extending from the bottom of the handle portion 13 in the manner well known in the art. Other types of control circuitry which provide a variety of fan speed/heating settings, as well as a dual voltage capability, may be provided in a manner well known in the art.

The upper part of the handle portion 13 is integrally molded at about the mid-point of the air flow portion 14 to provide for a balanced easy-to-manipulate hair dryer 10. The air flow portion 14, which may be approximately three inches in length, defines an air inlet 17 and an air exhaust or outlet 18. Preferably the air inlet 17 is generally circular in shape and the air flow portion 14 gradually forms an air outlet 18 of a generally rectangular cross section. The generally rectangular cross section of air outlet 18 includes shorter upper and lower parallel sides which each include an integrally molded stud or post such as posts 19 and 20 to be used with snap-on attachments, in a manner well known in the art.

Attachment 21, which includes a styling portion 22 such as a comb or brush, has upper and lower plastic resilient arms 23 and 24. Apertures 25 and 26 are defined respectively in upper and lower arms 23 and 24 to provide a snap fit over posts 19 and 20, all in a manner well known in the art. Other types of mounting arrangements for styling attachments are suitable when the hair dryer is to be used for styling the hair.

Figure 2:
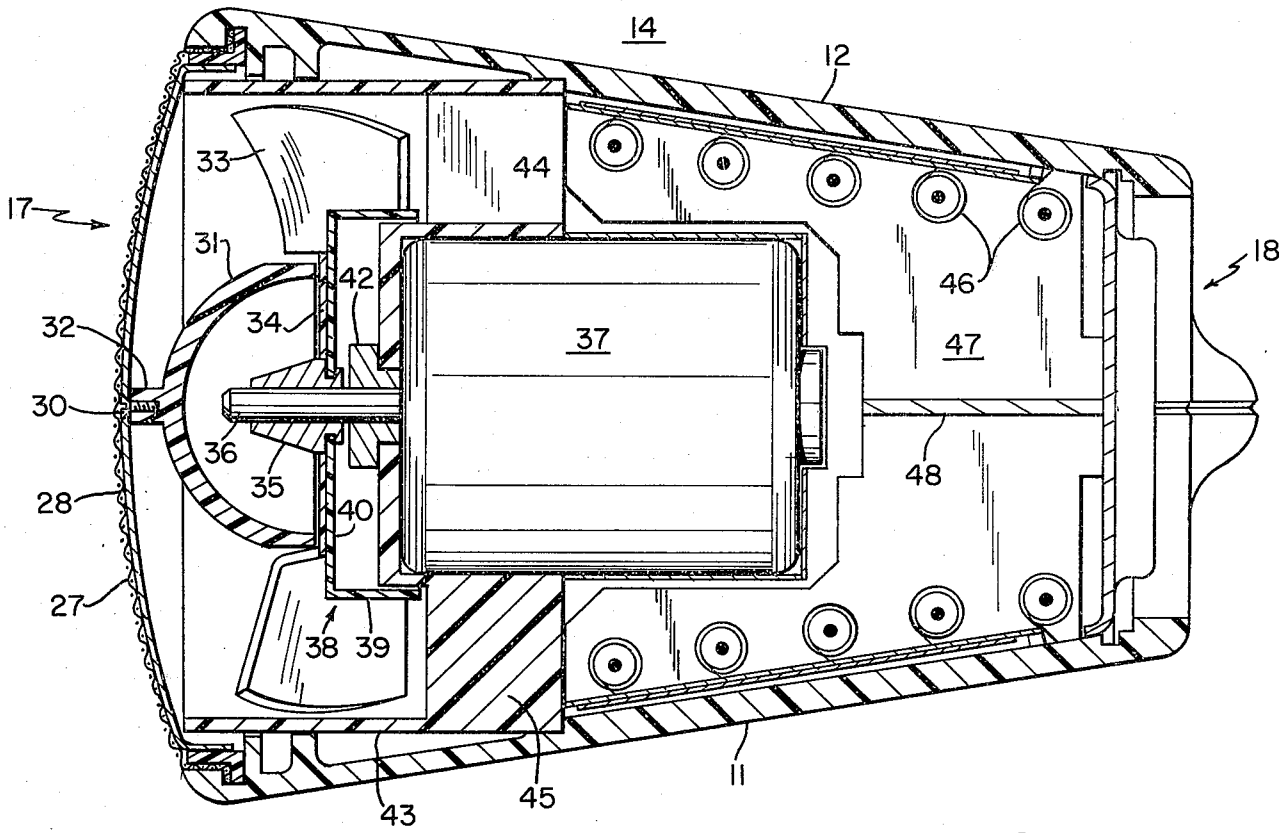
FIG. 2 is a cross-sectional top view of the air flow portion of the hair dryer of FIG. 1, in accordance with this invention.
Figure 3:
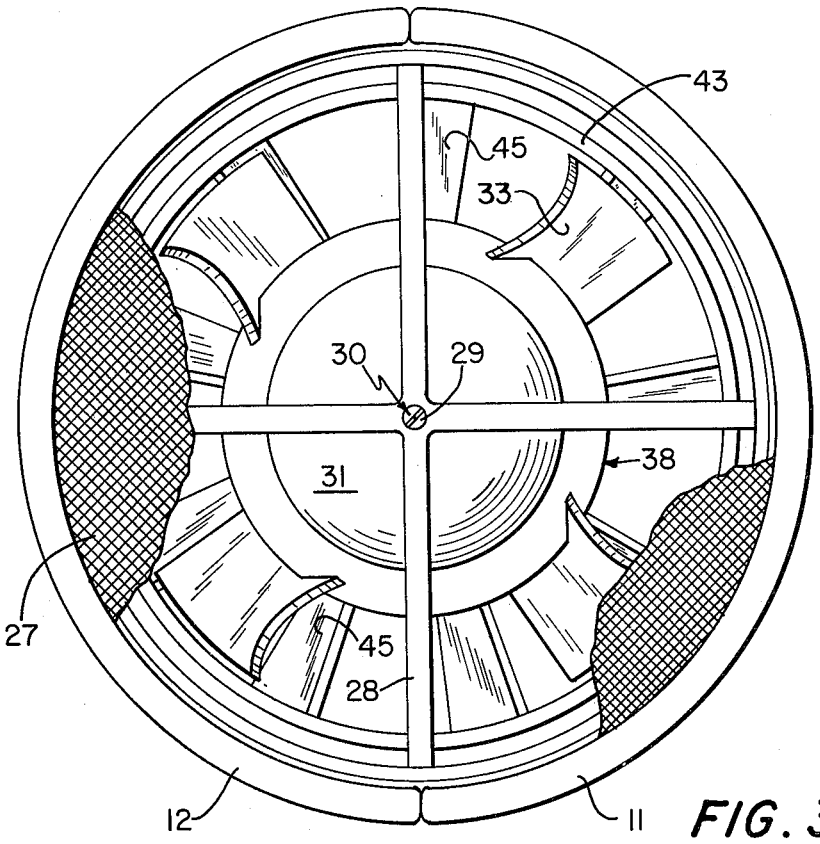
FIG. 3 is an end view, partial in section, of the air inlet of the air flow portion of the hair dryer of FIG. 1, in accordance with this invention.

Referring now to FIGS. 2 and 3 of the drawings, air is drawn in through the air inlet 17 of the air flow portion 14 through a wire mesh screen 27. The screen 27 is interlocked at its generally circular periphery into the cabinet sections 11 and 12 in a manner well known in the art. Disposed downstream from the screen 27 is a screen support 28 best seen when referring to FIG. 3. The screen support 28 is made up of a piece of metal, plastic or the like preferably in a generally cross configuration and of minimum size in order to block as little of the air passageway as possible. The crosslike screen support 28 is bowed out toward the screen 27 to provide structural rigidity to the screen 27. The center point of the support 28 defines an aperture 29 through which a securing member such as screw 30 fixes a guard or shield 31 to the support 28. The screen support 28 may be interlocked into the sections 11 and 12 of housing 10 or otherwise affixed thereto in any manner well known in the art.

The guard or shield 31 may be made of a plastic and is generally dome shaped. The shield 31 is connected to the screen support 28 through its integrally molded threaded mounting post 32. The shield 31 is positioned such that it provides proper clearance to the fan blades 33 and fan hub 34. The smooth downstream outer surface of the shield 31 provides minimum air flow restriction. The shield 31 is fixed only to the center portion of the screen support 28 to minimize air flow restriction problems and also to substantially prevent the knotting problem previously described. That is, if loose hair gets through the screen 27, it tends to collect or wind about the mounting post 32. The resulting hair causes little air flow restriction and does not detrimentally affect the operation or safety of the hair dryer.

Further, when hair connected to the user finds its way through the screen 28 onto the outer surface of the shield 31, the aerodynamic forces that are present still cause the hair to migrate toward the center of the system. However, because the shield 31 is present, the user's hair tends to lay across the outer surface of the shield 31. Since the hub is not spinning, the hair tends not to get knotted. Thus, when the dryer is moved away from the hair, the hair strands in the dryer laying on the surface of the shield 31 will tend to ease readily through the mesh of the screen 27.

Disposed within the upstream inner surface of the dome shaped shield 31 is a brass bushing 35 which, in a manner well known in the art, mounts the fan 33 with its hub 34 to the motor shaft 36. The fan 33 is a stamped aluminum fan having a plurality of blades 33, such as four in number, all joined by means of the generally circular fan hub 34. The fan hub 34 has a centrally defined aperture through which the motor shaft 36 is disposed.

Between the upstream portion of the motor 37 in the bushing 35 and the downstream side of the fan hub 34 and connected to the downstream portion of the fan blades 33 is a rotating collar 38. The collar 38 which may be integrally formed of plastic or formed as a stamped metal piece with the fan assembly (fan 33 and fan hub 34) is generally cylindrical in shape and comprises a wall portion 39, concentrically disposed about part of a motor mount 44, and a top portion 40. The top portion 40 is, of course, generally circular and defines a central aperture for receiving the motor shaft 36 and motor bearing 42. The length of the wall portion 39 of the collar 38 is preferably long enough to extend beyond the most downstream portion of the fan blades 33 such as extended portion 41. The extended portion 41 of the collar 38 beyond the fan blades 33 is believed to aid in the prevention of hair entanglement problems previously described.

In general, the collar 38 on its upstream surface is affixed to fan blades 33 and bushing 35 and accordingly rotates in unison with the fan blades 33 about the motor axis 36. The collar 38 substantially prevents hair connected to the user from wrapping around the motor shaft 36 on the downstream side of bushing 35 and pulling the user toward the hair dryer. In addition, the collar 38 substantially prevents loose hairs from being disposed about the motor shaft 36 and interfering with the normal operation of the system and causing premature breakdown and customer dissatisfaction.

The motor 37 is capable of driving the associated fan assembly, made up of blades 33 and fan hub 34, and collar 38 at about 15,000 to 18,000 rpm. The motor 37 is a DC permanent magnet motor such as that manufactured by Mabuchi in Japan as Model RS-365. However, it is understood that the choice of a motor is not critical in practicing this invention.

If desired, in order to take the spin out of the air flow, a fixed vane assembly is provided. Although not necessary for the practice of this invention, the fixed vane assembly provides a more efficient hair dryer system. In general, the fixed vane assembly may be formed of a plastic such as polycarbonate and comprises an integrally formed generally cylindrical shroud 43 disposed about the outside of the fan/motor assembly and a generally cylindrical motor mount 44 disposed about an upstream portion of motor 37. The inner surface of the shroud 43 and the outer surface of the motor mount 44 are interconnected through a plurality of air foils or fixed vanes 45, such as nine in number, all in a manner well known in the art. The shroud 43 may extend about the fan blades 33 and also about the fixed vanes 45 located downstream from the fan blades 33.

Located downstream from the fixed vane assembly are concentrically wound iron chrome resistance wire heater coils 46 disposed in the downstream portion of the air flow portion 14 and partially disposed about the motor 37. The coils 46 are mounted in appropriate slots of Micaboards 47 and 48 in a manner well known in the art. The Micaboards 47 and 48 in turn are connected to the inner walls of sections 11 and 12 of housing 10.

An air exhaust grill 49 is disposed over the air exit or outlet 18 and is interconnected to sections 11 and 12 of housing 10 and Micaboards 47 and 48 through interlocks or the like.

While an embodiment and application of the invention has been shown and described, it will be apparent to those skilled in the art that many more modifications are possible without departing from the inventive concepts herein described. The invention, therefore, is not to be restricted except as is necessary by the prior art and by the spirit of the appended claims.

What is claimed as new and desired to be secured by Letters Patent of the United States is:

1. A portable hair dryer comprising a handle portion and an air flow portion, said air flow portion defining an air inlet and an air outlet, said air flow portion including a motor driven axial fan assembly wherein said axial fan is driven by said motor through a connecting motor shaft which passes through said axial fan, and stationary substantially air-impervious shield means for blocking the line of sight path to the portion of said motor shaft between said axial fan and said air inlet, said shield means being disposed about and substantially enveloping the portion of said motor shaft beyond said axial fan, an inlet structure mounted in said air inlet, said shield means including a mounting post around which loose hair, which gets through said air inlet structure, tends to collect, wherein said shield means is connected to said inlet structure at said mounting post, and collar means disposed between said axial fan assembly and said motor and affixed to said fan assembly for movement therewith wherein said collar means blocks the line of sight path to the portion of said motor shaft between said axial fan and said motor.

2. The hair dryer as in claim 1 wherein said air outlet includes means for releasably receiving associated styling attachments.

3. The hair dryer as in claim 2 wherein said air inlet is of generally circular shape and said air outlet is of generally rectangular shape.

4. The hair dryer as in claim 1 wherein said inlet structure is cross shaped and further including a screen member disposed over the upstream side of said inlet structure.

5. The hair dryer as in claim 1 wherein said collar means includes side walls extending beyond the bottom portion of the downstream side of said axial fan assembly.

6. A portable hair dryer comprising a dryer housing having a handle portion and an air flow portion, said air flow portion defining an air inlet of generally circular shape and defining a single air outlet of generally rectangular shape adapted to releasably receive a mating attachment, said air flow portion including an axial fan means, including a fan mounted on a motor through a motor shaft which passes through said fan, said fan being axially disposed within said air flow portion for drawing a stream of air into said air inlet, through said air flow portion and out said air outlet, said axial fan means being aligned with said air outlet to cause the stream of air to pass directly from said axial fan means through said air outlet without change of direction, and means for substantially preventing hair entanglement from said air inlet including stationary substantially air-impervious, dome shaped shield means for blocking the line of sight path to the portion of said motor shaft between said axial fan and said air inlet, said shield means being disposed about and substantially enveloping the portion of said motor shaft beyond said fan, an inlet structure mounted in said air inlet, said shield means including a mounting post around which loose hair, which gets through said inlet structure, tends to collect, wherein said shield means is connected to said inlet structure at said mounting post, and collar means disposed between said axial fan and said motor and affixed to said fan for movement therewith wherein said collar means blocks the line of sight path to the portion of said motor shaft between said axial fan and said motor.

7. The hair dryer as in claim 6 wherein said collar means includes side walls extending beyond the bottom portion of the downstream side of said axial fan.

* * * * *